US007402242B2

(12) United States Patent
Duckett

(10) Patent No.: US 7,402,242 B2
(45) Date of Patent: Jul. 22, 2008

(54) SWIMMING POOL DEBRIS REMOVING SKIMMER

(76) Inventor: Richard Duckett, 2601, Ch. Oka, Deux-Montagnes, Quebec (CA) J7R 4V4

( * ) Notice: Subject to any disclaimer, the term of this patent is extended or adjusted under 35 U.S.C. 154(b) by 65 days.

(21) Appl. No.: 11/654,243

(22) Filed: Jan. 16, 2007

(65) Prior Publication Data

US 2007/0175808 A1 Aug. 2, 2007

(30) Foreign Application Priority Data

Feb. 2, 2006 (CA) ..... 2535152

(51) Int. Cl.
*B01D 33/048* (2006.01)
*B01D 35/027* (2006.01)
*E04H 4/14* (2006.01)

(52) U.S. Cl. ..... 210/167.12; 210/167.14; 210/400

(58) Field of Classification Search ..... 210/167.1, 210/167.12, 167.14, 167.19, 400
See application file for complete search history.

(56) References Cited

U.S. PATENT DOCUMENTS 4,485,013 A * 11/1984 Cockman ..... 210/242.2
5,928,520 A * 7/1999 Haumesser ..... 210/747
6,029,290 A 2/2000 Butcher
6,210,568 B1 * 4/2001 Harder ..... 210/167.12
2007/0029168 A1 * 2/2007 Lane ..... 198/497

FOREIGN PATENT DOCUMENTS

JP 2005-295859 * 10/2005

* cited by examiner

*Primary Examiner*—Fred Prince

(57) ABSTRACT

This invention relates to a novel floating debris removing skimmer for swimming pool and other similar bodies of water. The skimmer comprises a generally rectangular enclosure which comprises an inlet opening coupled to a flow control door or flapper. The skimmer further comprises a conveyor assembly which comprises a pair of cylinders around which is disposed a conveyor belt. The first cylinder is located at the top generally on the side opposing the inlet opening. The second cylinder is located near the inlet opening and preferably under the water level when the skimmer is installed. One of the cylinders is motorized so that when a debris, carried by the water through the inlet opening, is pushed against the conveyor belt, it is carried by the belt toward the top of the enclosure and ultimately outside the enclosure. The conveyor belt does not extend above the skimmer.

18 Claims, 10 Drawing Sheets

SWIMMING POOL DEBRIS REMOVING SKIMMER

This application claims priority based on canadian patent application 2,535,152 filed Feb. 2, 2006

FIELD OF THE INVENTION

This invention relates to a debris removing skimmer for swimming pool. More particularly, this invention relates to an automated or motorized debris removing skimmer for swimming pool.

BACKGROUND OF THE INVENTION

Swimming pools are generally filtered by a two levels filtration system. The first level is a skimmer assembly which removes the largest debris such as pine cones, leaves, fruits, large bugs and the like which have fallen into the water. The water exiting the skimmer assembly is generally pumped to the second finer filtration level. This second filter is generally a sand filter that removes the finest debris which have passed through the skimmer.

Skimmer assemblies are generally known in the art. These skimmers generally comprise a cylindrical enclosure mounted to the wall of the pool. The enclosure comprises an inlet opening and a flow control door through which the water can enter the skimmer. Inside the skimmer, there is found a basket comprising a plurality of apertures. The apertures are designed to allow the passage of the water but to block the passage of the largest debris, effectively skimming the water. However, overtime, the basket may become clogged with debris and hinder the passage of the water which may affect some components of the second stage of filtration such as the pump.

The basket of these skimmers therefore needs to be emptied regularly by the owner of the pool. This is a tedious chore and prone to being forgot from time to time.

There exist, in the prior art, systems to automatically skim and remove the debris from the water. One of theses systems can be seen in U.S. Pat. No. 6,029,290 granted to Butcher et al. In the patent of Butcher et al., the skimmer cleaner comprises a separate conveyor belt assembly which has a portion immersed in water while the other portion is outside of the water. The conveyor assembly, mounted at an angle, is arranged to that the debris going to the top of the assembly will fall away from the skimmer, preferably in a receptacle. The problem with the skimmer cleaner of Butcher et al. is the fact that the conveyor assembly extends above of the skimmer. Without altering the functionality of the system, the skimmer cleaner of Butcher et al. is aesthetically unpleasant, bulky and may be difficult to install. Also because of its design limitations, the belt angle is too steep to be effective with larger debris.

In today's world where aesthetic is almost as important as functionality, there is a need for a debris removing skimmer for use with a swimming pool which is compact, effective and preferably discrete.

OBJECTS OF THE INVENTION

Accordingly, an object of the present invention is to provide a debris removing skimmer which uses a conveyor belt which does not extend above the skimmer body or enclosure.

Another object of the present invention is to provide a debris removing skimmer which is generally compact.

Other and further objects and advantages of the present invention will be obvious upon an understanding of the illustrative embodiments about to be described or will be indicated in the appended claims, and various advantages not referred to herein will occur to one skilled in the art upon employment of the invention in practice.

SUMMARY OF THE INVENTION

To attain these and other objects which will become more apparent as the description proceeds according to several aspects of the present invention, there is provided a debris removing skimmer for a swimming pool.

According to the present invention, the debris removing skimmer is adapted to be mounted on the wall of a swimming pool, preferably at water level.

The skimmer of the present invention generally comprises an enclosure, which, in a preferred embodiment has a rectangular or box-like shape. In the preferred embodiment, the enclosure comprises a front surface, a rear surface, two generally parallel and opposing side surfaces and a bottom surface.

The front surface further comprises an inlet opening, preferably but not exclusively of rectangular shape. Preferably coupled to the inlet opening is a flow control door or flapper with is pivotally mounted to the enclosure along a preferably horizontal axis. The flow control door prevents backflow of the debris into the pool.

The skimmer is designed to fit onto the standard adapter to the wall opening of the swimming pool.

The bottom surface further comprises a draining hole that allows the skimmed water to proceed to the next filtration step.

According to one aspect of the invention, the skimmer further comprises a conveyor belt assembly. The assembly comprises a belt disposed around two rollers or cylinders. The assembly is mounted at an angle inside the enclosure so that a first cylinder is higher than the second cylinder. The first cylinder is preferably located near the top of the enclosure and generally near the rear surface while the second cylinder is preferably located near the lower edge of the inlet opening. One of the two cylinders is preferably motorized so that debris landing on the belt are carried upward toward the exit of the enclosure.

According to another aspect of the invention, a brush assembly or similar device is preferably installed near the first cylinder. The brush assembly comprises a plurality of bristle clusters which help to remove any debris that might have stuck to the belt.

According to yet another aspect of the invention, the conveyor assembly is located completely inside the enclosure.

According to still another aspect of the invention, the conveyor assembly does not extend above the enclosure.

According to another aspect, the top of the enclosure is covered by a removable cover which allows an easy access to the inside of the enclosure.

Other aspects and many of the attendant advantages will be more readily appreciated as the same becomes better understood by reference to the following detailed description and considered in connection with the accompanying drawings in which like reference symbols designated like elements throughout the figures.

The features of the present invention which are believed to be novel are set forth with particularity in the appended claims.

DETAILED DESCRIPTION OF THE PREFERRED EMBODIMENT

The present invention relates to an automated debris removing skimmer 10 preferably for swimming pool.

The preferred embodiment of the debris removing skimmer (hereinafter "skimmer") 10 of the present invention can generally be seen in FIGS. 1 to 6.

Figure 1:
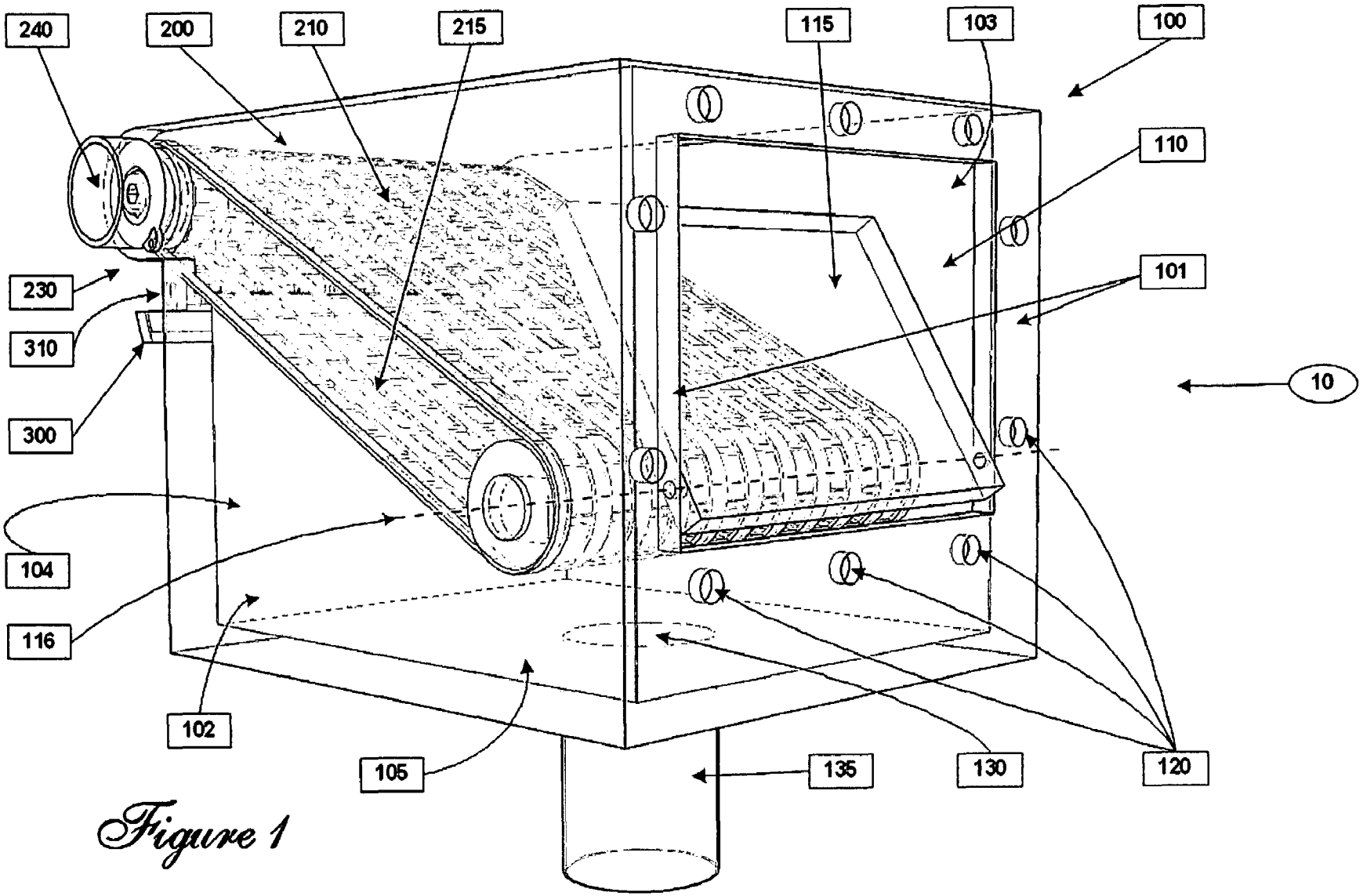
FIG. 1 is a front left perspective translucent view of the present invention without the cover.

Now referring to FIG. 1, we can see a perspective view of the skimmer 10 of the present invention. The skimmer 10 generally comprises enclosure 100. In its front surface 101, the enclosure 100 comprises a generally rectangular opening or aperture 110. Adjacent to the opening 110 and pivotally mounted on the enclosure 100 is a flow control door or flapper 115. The skimmer 10 further comprises a conveyor belt assembly 200. The belt 210 (see also FIGS. 7 and 8) preferably comprises a plurality of holes or apertures 215 of given dimensions. As can be clearly seen in FIGS. 1 and 2, the conveyor belt assembly 200 is installed at an angle inside the enclosure 100. Preferably, the conveyor assembly is motorized with a motor 240 (see also FIG. 4) operatively connected or interconnected to the conveyor assembly 200. The conveyor assembly 200 is mounted and installed so that the movement of the belt 210 is an upward movement. Mounted on the rear side of the enclosure 100 and located under the generally top portion 230 of the conveyor assembly 200 is the brush assembly 300. Finally, the skimmer 10 comprises a cover or lid 400 (see FIGS. 3, 4 and 10).

In the preferred embodiment, the enclosure 100 is installed so that the level of the water in the swimming pool reaches approximately half the height of the opening 110. When a portion of water enters the enclosure 100 with a floating debris (not shown), the water flows through the holes 215 of the belt 210. However, if the debris is larger than the holes 215, it remains on the belt 210 and is carried upward toward the exit of the enclosure 100 by the movement of the belt 210. For generally large and solid debris such as large bugs, pine cones, fruits and the like, when the debris reaches the top of the conveyor assembly 200, it falls away with the help of gravity preferably in a receiving receptacle (now shown). For smaller or sticky debris such as dead leaves, when the debris reaches the top of the conveyor assembly 200, it is removed from the belt 210 with the help of the bristle clusters 310. The removed debris similarly falls into a receiving receptacle.

Having now described the general components and functionality of the skimmer 10, the skimmer 10 and its components shall now be described in more details.

To begin with, the skimmer 10 comprises the enclosure 100, which is a generally rectangular or box-like structure. The exact shape shown in the accompanying figures is for illustration purpose only and other shapes could be envisaged. However, it is preferred that the shape of the enclosure 100 generally matches the shape of the conveyor assembly 200 so that debris may not fall between the belt and the surfaces of the enclosure 100. Thus, in the preferred embodiment, the enclosure 100 generally comprises a front surface 101, two opposite and generally parallel surfaces 102 and 103, a rear surface 104 and a bottom surface 105.

The front surface 101 comprises a generally rectangular inlet opening 110 and a plurality of mounting holes 120 located at the periphery of the opening 110. The mounting holes are used to secure the enclosure 100 to the wall of the swimming pool. Pivotally mounted inside the inlet opening 110 is a flow control door or flapper 115. The shape of the flapper 115 generally matches the shape of the opening 110. Furthermore, in the preferred embodiment, the flapper 115 pivots about a generally horizontal axis 116 located in the lower portion of the opening 110.

The bottom surface 105 generally comprises a draining hole 130 to which is coupled a draining pipe 135. The draining pipe 135 is preferably connected to a piping circuit leading to a further filtration system (i.e. generally a sand filter).

The back surface 104 is generally rectangular. However, the upper portion of the back surface 104 comprises a generally rectangular opening 140 (see FIG. 5). The opening 140 generally has a width slightly larger than the width of the conveyor belt assembly 200. The opening 140 allows the passage of the upper portion 230 of the conveyor belt assembly 200.

The side surfaces 102 and 103 complete the enclosure 100. These surfaces 102 and 103 provide two pairs of pivotal mounting means 152, 154 and 156, 158. The first pair, 152 and 154, are located near the opening 140 of the rear surface 104. Pivotal mounting means 152 and 154 generally comprise holes which match the small shafts 236 and 239 of the cylinder 235 of the conveyor assembly. The second pair 156 and 158 of pivotal mounting means generally consist is a pair of U-shape cup protruding inwardly. The size and shape of the mounting means 156 and 158 generally match the size and shape of the shafts 226 and 227 of the second cylinder 225 of the conveyor assembly 200.

The conveyor assembly 200 of the present invention generally comprises two cylinders 225 and 235 around which is generally disposed a belt 210.

The belt 210 is preferably made of a flexible material such a fabric, rubber, wire mesh, screen or the like. In the preferred embodiment, the belt 210 is made of rubber albeit this choice is by no means limitative in nature. Still in the preferred embodiment, the belt generally comprises a plurality parallel and evenly spaced band portion 211. The band portions 211 are interconnected via transverse connecting portions 213. The assembly of the plurality of band portions 211 and connecting portions 213 defines a plurality of apertures 215, generally longitudinally aligned and disposed in a plurality of parallel rows. These apertures 215 allow the water that enters the enclosure 100 to flow through the belt 210 and toward the draining hole 130 while simultaneously blocking the larger debris (the debris larger than the holes 215). The skilled addressee will understand that the particular belt 210 described above should not be construed as limitative in nature and belts of other configurations could be used.

As partially explained above, the conveyor assembly 200 comprises two cylinders 225 and 235. Cylinder 225, located in the lower portion 220 of the conveyor assembly 200, is preferably mounted at the bottom of the enclosure 100 and near the inlet opening 110. When the skimmer is in use, the cylinder 225, and the lower portion 220 of the conveyor assembly 200, are generally under water. The cylinder 225 comprises, at both end, small shafts 226 and 227 which are adapted to be mounted inside the pivotal mounting means 156 and 158 respectively. These shafts 226, 227 and pivotal mounting means 156, 158 combinations allow the cylinder 225 to rotate and activate the belt in the necessary rotary motion.

Figure 7:
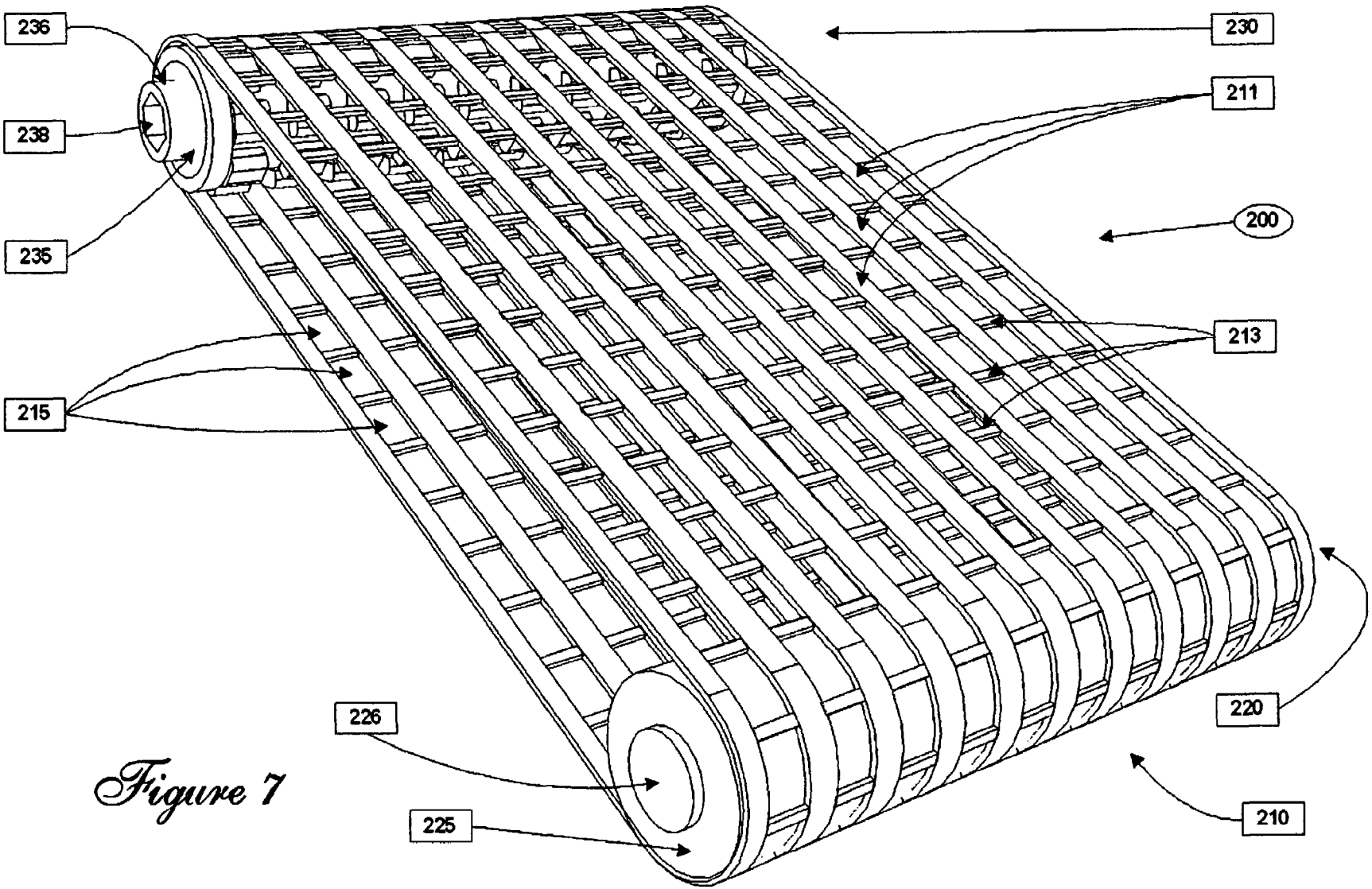
FIG. 7 is front left perspective view of the conveyor belt assembly of the present invention.
Figure 8:
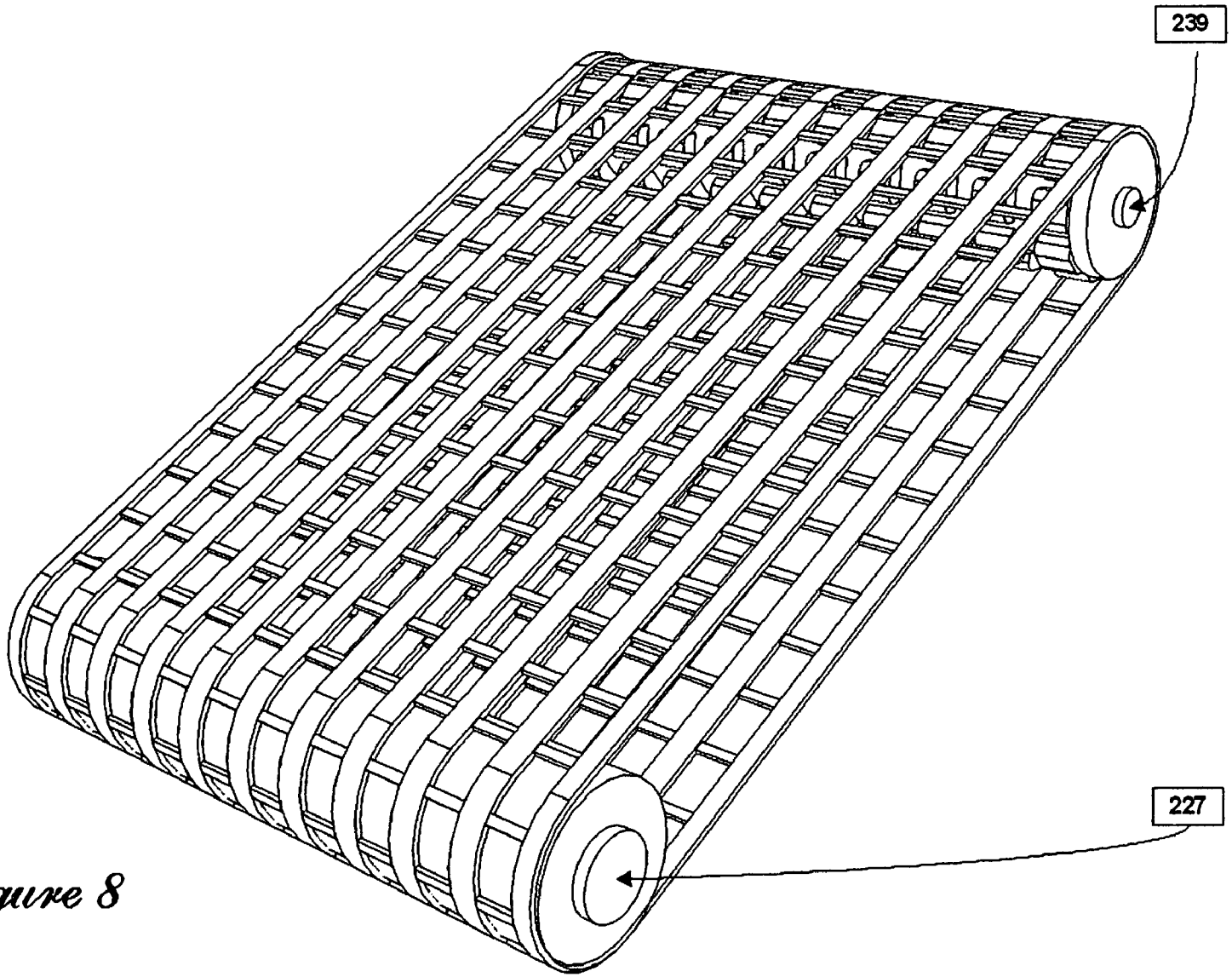
FIG. 8 is front right perspective view of the conveyor belt assembly of the present invention.

Cylinder 235 is slightly more complex. The cylinder 235 is located near the opening 140 of the rear surface 104. Cylinder 235 is thus higher than cylinder 225. At one of its ends, the cylinder 235 comprises a small shaft 239 adapted to be mounted inside pivotal mounting means 154. At the other end is disposed another shaft 236, mounted in mounting means 152, which further comprises a bore or keyhole 238. The bore 238 provides coupling means to couple the axle of the motor 240 to the cylinder 235. In FIG. 7, the bore has a hexagonal shape. However, the skilled reader will readily understand that other coupling means could be used as long as the motor can drivingly engage the cylinder 235.

Any kind of motors (electric, gas powered, etc.) or even a water powered turbine could be used but in this embodiment, a small electric motor is preferred. Moreover, it is to be understood that the motor 240 needs not to be directly connected to the cylinder 235. A transmission system between the motor 240 and the cylinder 235 could indeed be used if required.

When the motor 240 is actuated, its transmits its power to the cylinder 235 via the motor axle and the bore 238. The rotating cylinder 235 engages the belt 210 which starts to move in an upward motion. Thus, any debris located on the belt will be carried upwardly toward the exit of the enclosure 100. It is to be understood that the material and shape of the belt 210 and the cylinders 225 and 235 are chosen as to prevent slippage between the belt 210 and at least the driving cylinder 235. In the preferred embodiment of the present invention, the belt 210 is frictionally engaged by at least the motor driven cylinder 235. However, other means to drivingly engage belt 210 by cylinder 235 could be envisaged such as drive lugs and/or sprocket wheel.

Figure 9:
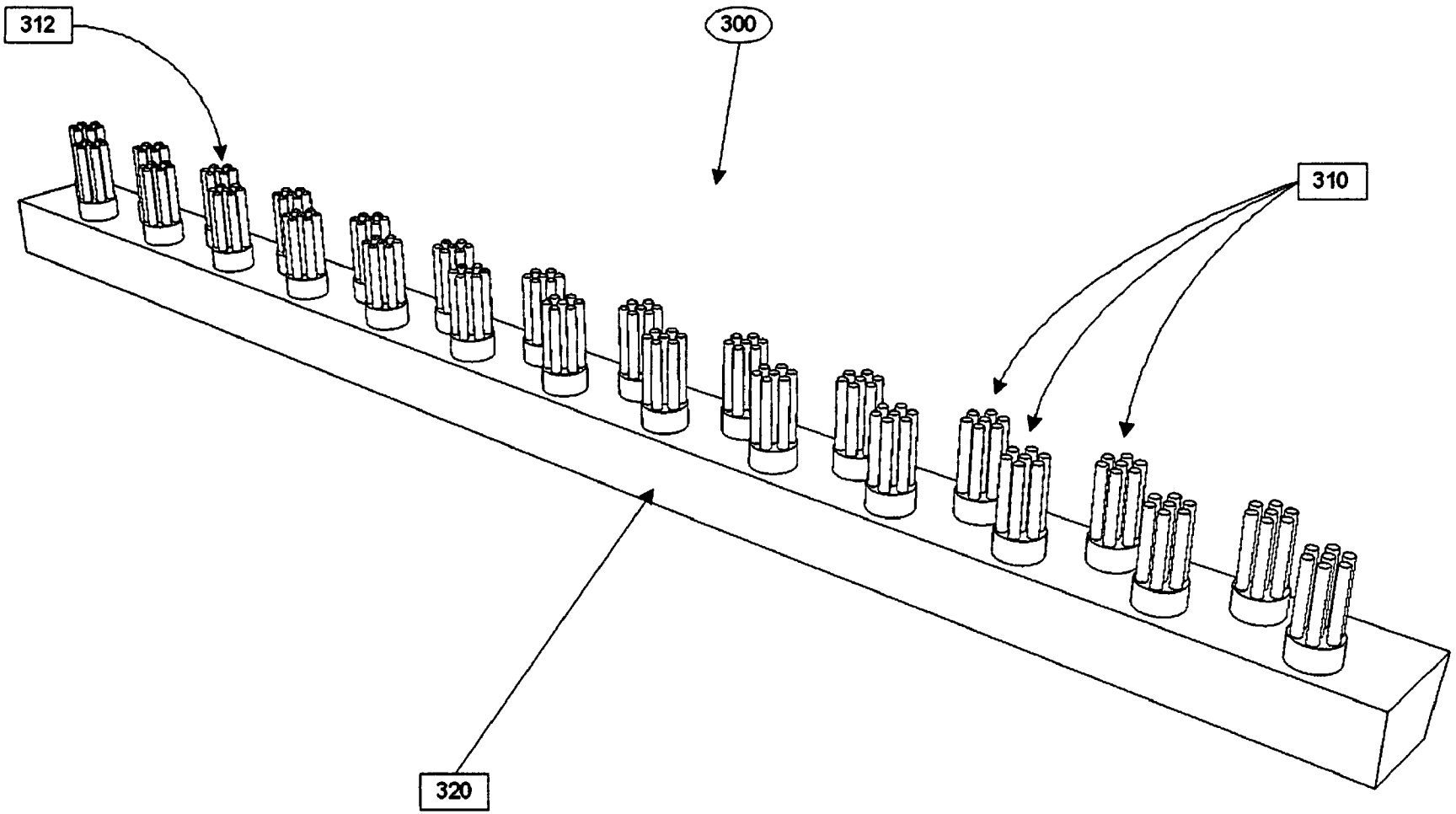
FIG. 9 is a perspective view of the brush of the present invention.

Referring to FIG. 9, the brush assembly 300 generally comprises an elongated support structure 320, adapted to be attached to the rear surface 104 of the enclosure 100. Located on the support structure 320 and disposed in a preferably staggered arrangement are pluralities of bristle clusters 310. Each cluster 310 preferably comprises a plurality of bristles 312. These bristles 312 are preferably made of a flexible yet resilient material such as rubber, polyethylene, polypropylene and the like. The skilled addressee will understand that the material of the bristles is not limited to these specific materials and that any flexible and resilient material could be used instead. In the preferred embodiment, the bristles 312 are preferably in close contact with the belt 210 in order to have an effective dislodgement of the debris.

Figure 4:
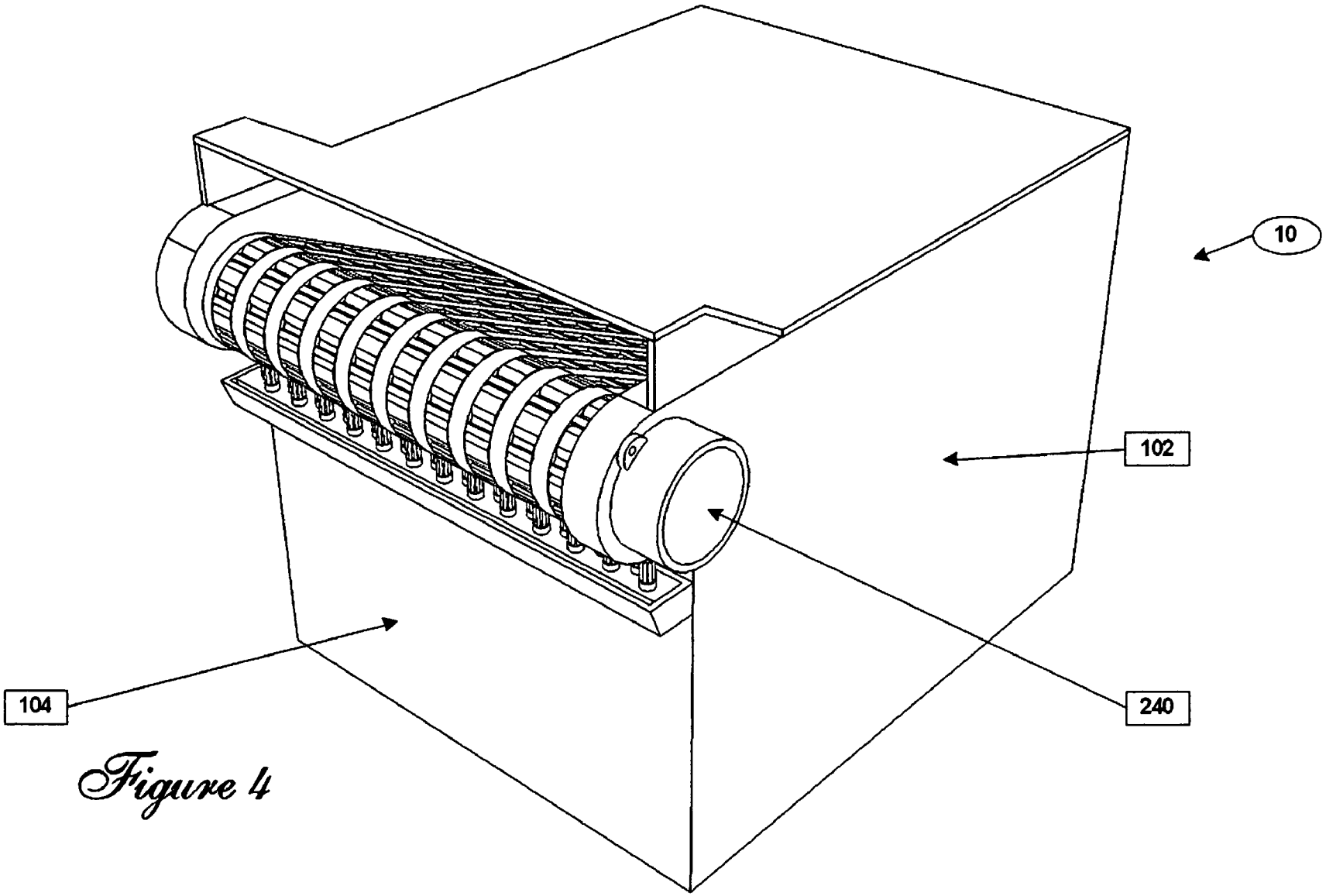
FIG. 4 is a rear left perspective view of the present invention with the cover.
Figure 5:
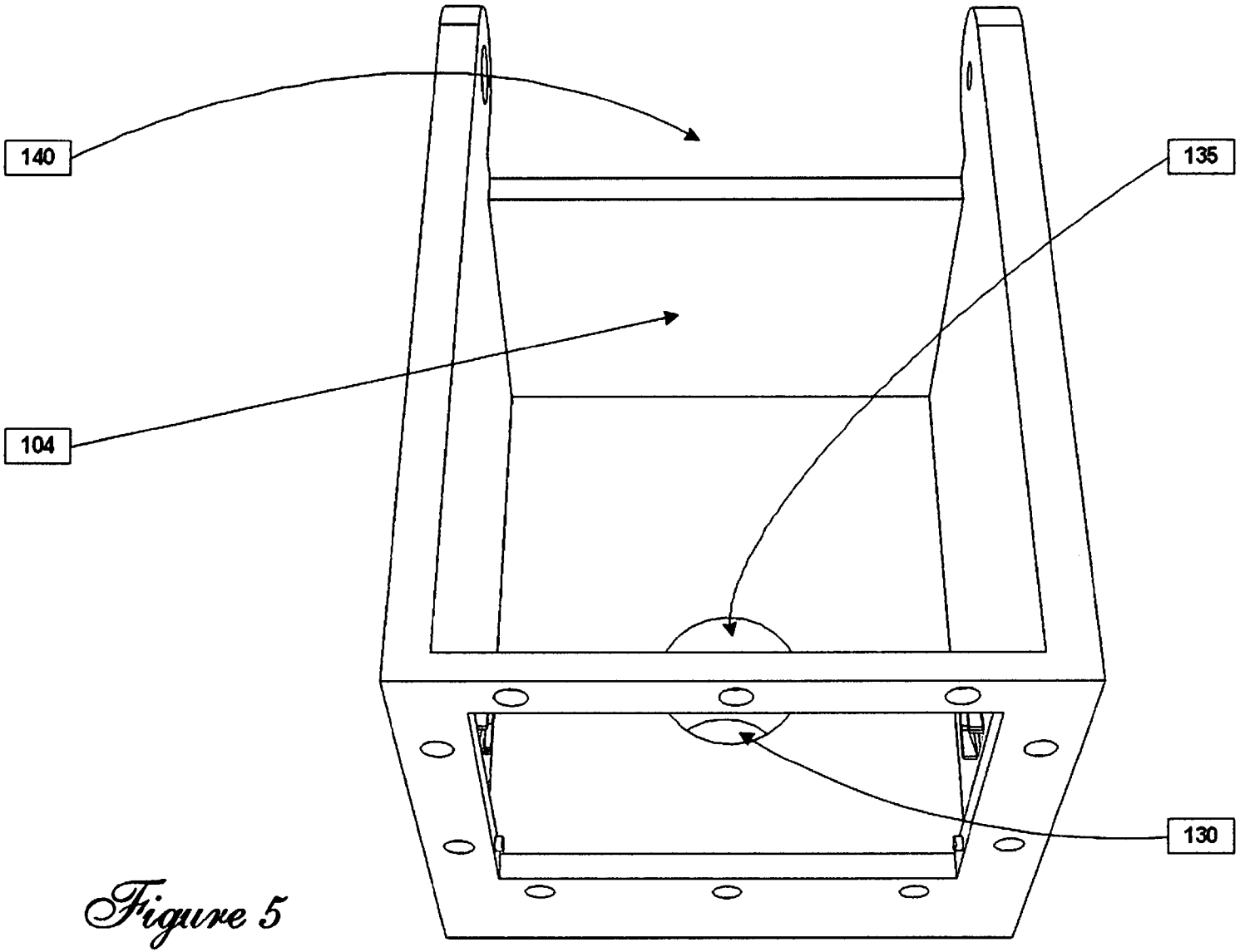
FIG. 5 is top front perspective view of the enclosure of the present invention.
Figure 6:
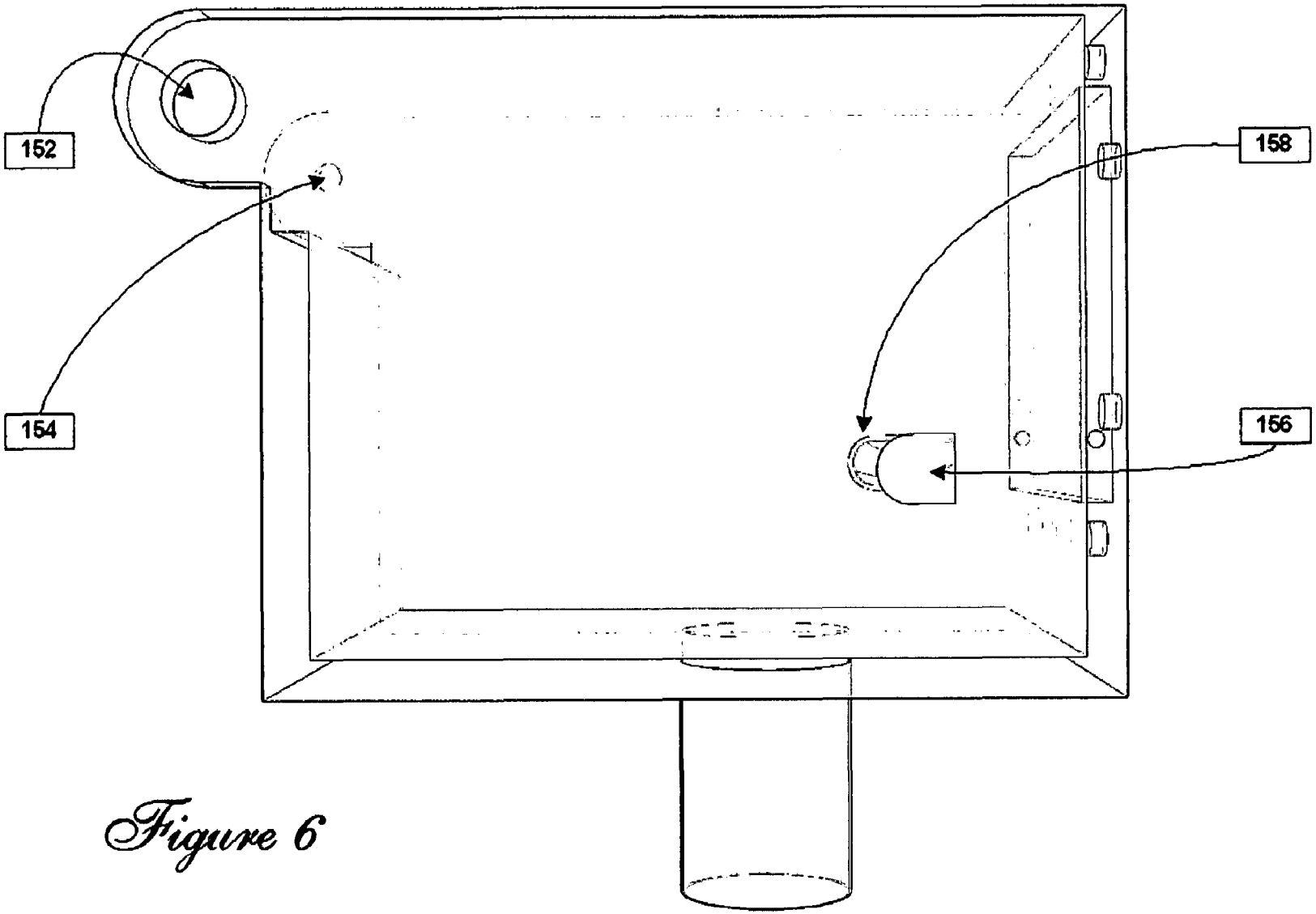
FIG. 6 is a left side perspective translucent view of the enclosure of the present invention.
Figure 10:
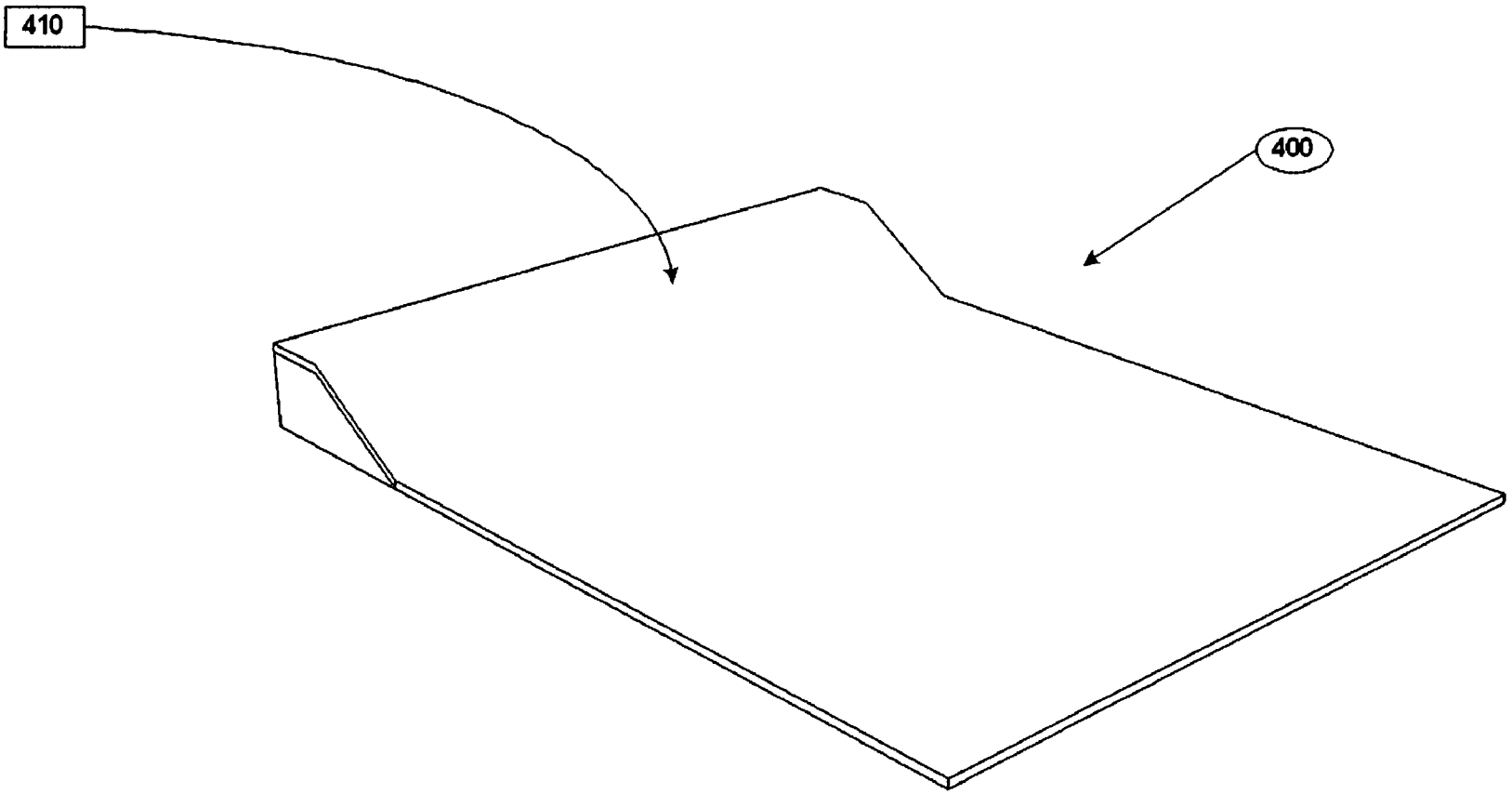
FIG. 10 is a perspective view of the cover of the present invention.

Now referring to FIG. 10, the cover 400 is a generally rectangular piece, which further comprises an outwardly projecting portion 410, adapted to cover the upper portion 230 of the conveyor assembly 200 as best shown in FIG. 4. The cover 400 is preferably removable in order to permit an easy access to the inside of the enclosure 100.

Figure 2:
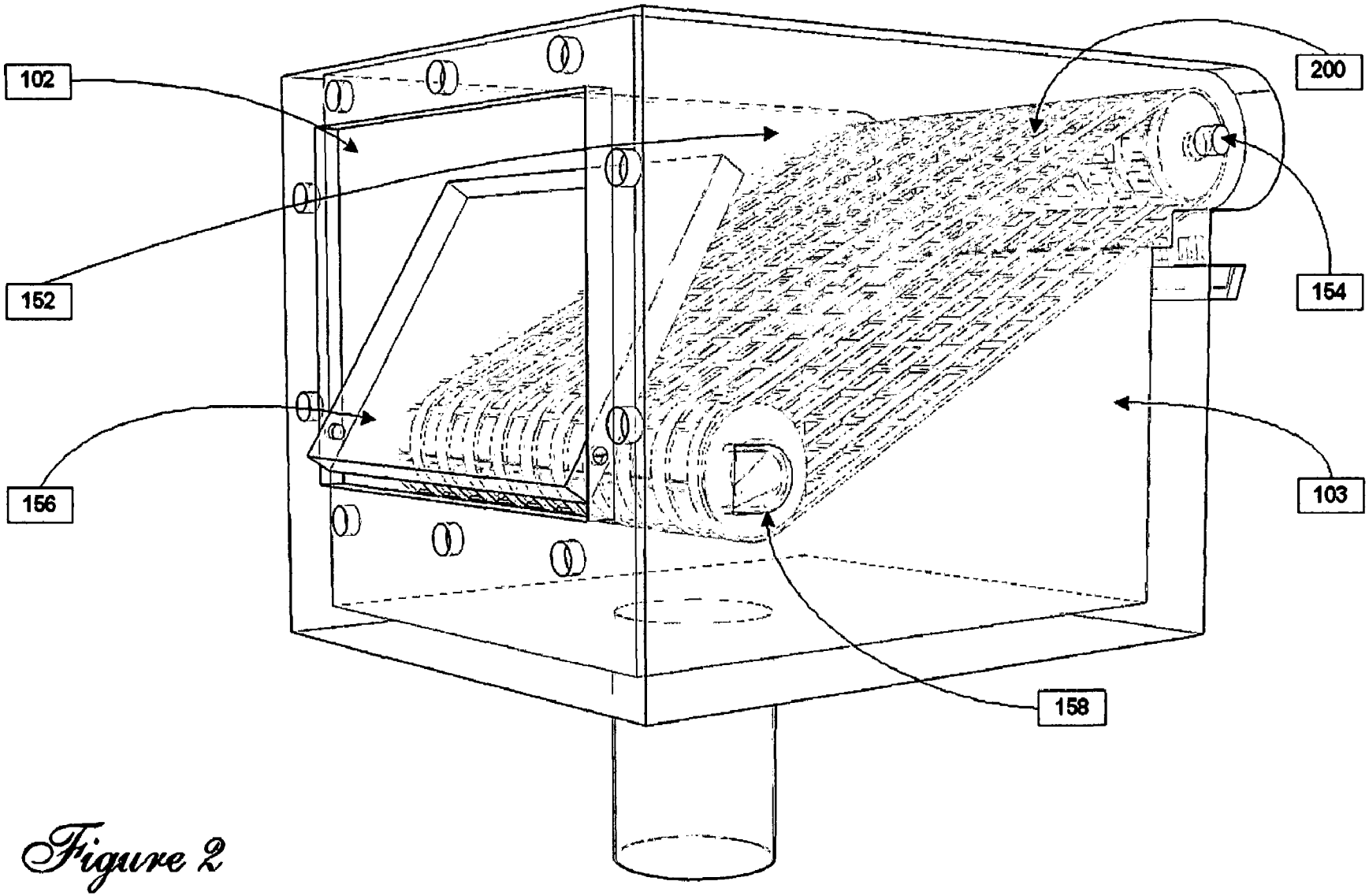
FIG. 2 is a front right perspective translucent view of the present invention without the cover.
Figure 3:
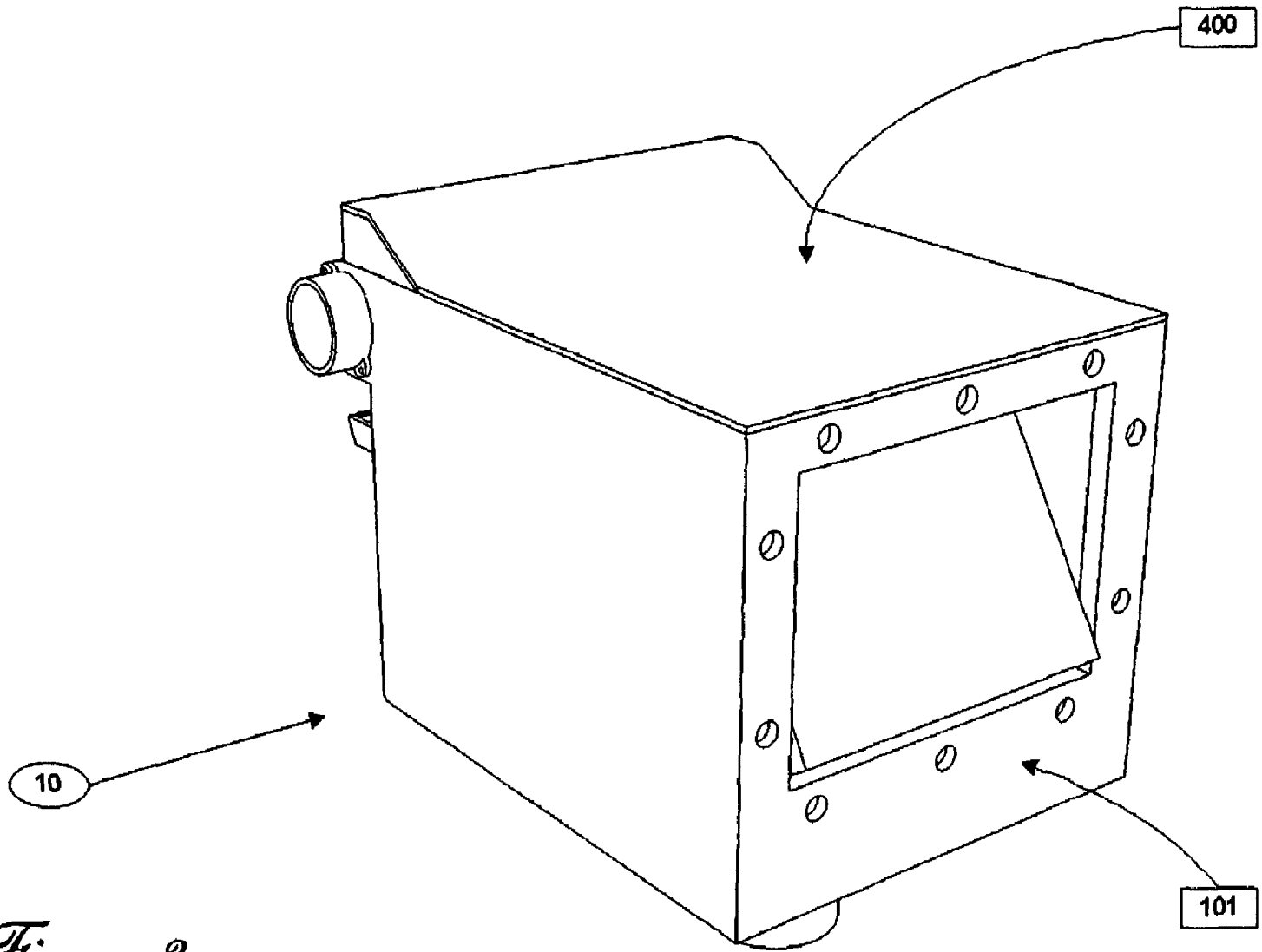
FIG. 3 is a front left perspective view of the present invention with the cover.

The fully assembled skimmer 10 is best shown in FIGS. 1 and 2 (without the cover 400). As generally described above, when a debris is carried inside the enclosure 100 of the skimmer 10 with the water, the water flows through the belt 210 while the debris remains on the belt 210. The belt 210 carries the debris upward toward the exit (opening 140) of the skimmer 10. At the upper end of the belt 210, the debris either falls down in the receiving receptacle (not shown) alone or with the help of the brush assembly 300. The belt 210 may be continuously or intermittently motorized. Moreover, a control system (not shown), connected to the motor 240, could control the time and duration of the motorization of the conveyor assembly 200.

Although preferred embodiments of the invention have been described in detail herein and illustrated in the accompanying figures, it is to be understood that the invention is not limited to these precise embodiments and that various changes and modifications may be effected therein without departing from the scope or spirit of the present invention.

The invention claimed is:

1. A debris removing skimmer for use with a swimming pool comprising at least a wall, said skimmer comprising:

a) an enclosure itself comprising a front surface, said front surface comprising an opening and being adapted to be mounted to said at least wall of said swimming pool;

b) a conveyor belt assembly comprising a first cylinder, a second cylinder and a belt disposed around said first and said second cylinders, said conveyor belt assembly being adapted to be mounted inside said enclosure;

c) a driving means operatively connected to either said first cylinder or said second cylinder, said driving means being able to move said belt;

wherein said first cylinder is located at a higher height than said second cylinder and wherein said conveyor belt assembly does not extend above of said enclosure.

2. A debris removing skimmer as claimed in claim 1 wherein said enclosure further comprises a bottom surface, a rear surface and two generally parallel and opposing side surfaces, each of said side surfaces further comprising a pair of pivotal mounting means.

3. A debris removing skimmer as claimed in claim 2 wherein said first and said second cylinders are pivotally mounted in said pivotal mounting means.

4. A debris removing skimmer as claimed in claim 1 wherein said belt is made of flexible material and further comprises a plurality of holes.

5. A debris removing skimmer as claimed in claim 1 further comprising a brush assembly located near said first cylinder.

6. A debris removing skimmer as claimed in claim 5 wherein said brush assembly further comprises a plurality of bristles.

7. A debris removing skimmer as claimed in claim 6 wherein said plurality of bristles are in at least partial contact with said belt.

8. A debris removing skimmer as claimed in claim 1 wherein said driving means is an electrical motor.

9. A debris removing skimmer as claimed in claim 1 wherein said enclosure further comprises a pivotally mounted flow control door.

10. A debris removing skimmer for use with a swimming pool comprising at least a wall, said skimmer comprising:

a) an enclosure itself comprising a front surface, said front surface comprising an opening and being adapted to be mounted to said at least wall of said swimming pool;

b) a conveyor belt assembly comprising a first cylinder, a second cylinder and a belt disposed around said first and said second cylinders, said conveyor belt assembly being adapted to be mounted inside said enclosure;

c) a driving means operatively connected to either said first cylinder or said second cylinder, said driving means being able to move said belt;

wherein said first cylinder is located at a higher height than said second cylinder and wherein said conveyor belt assembly is located substantially inside said enclosure.

11. A debris removing skimmer as claimed in claim 10 wherein said enclosure further comprises a bottom surface, a rear surface and two generally parallel and opposing side surfaces, each of said side surfaces further comprising a pair of pivotal mounting means.

12. A debris removing skimmer as claimed in claim 11 wherein said first and said second cylinders are pivotally mounted in said pivotal mounting means.

13. A debris removing skimmer as claimed in claim 10 wherein said belt is made of flexible material and further comprises a plurality of holes.

14. A debris removing skimmer as claimed in claim 10 further comprising a brush assembly located near said first cylinder.

15. A debris removing skimmer as claimed in claim 14 wherein said brush assembly further comprises a plurality of bristles.

16. A debris removing skimmer as claimed in claim 15 wherein said plurality of bristles are in at least partial contact with said belt.

17. A debris removing skimmer as claimed in claim 10 wherein said driving means is an electrical motor.

18. A debris removing skimmer as claimed in claim 10 wherein said enclosure further comprises a pivotally mounted flow control door.

* * * * *